US006632596B2

(12) United States Patent
Kuroda

(10) Patent No.: US 6,632,596 B2
(45) Date of Patent: Oct. 14, 2003

(54) SILVER HALIDE EMULSION

(75) Inventor: Koichiro Kuroda, Tokyo (JP)

(73) Assignee: Konica Corporation, Tokyo (JP)

( * ) Notice: Subject to any disclaimer, the term of this patent is extended or adjusted under 35 U.S.C. 154(b) by 69 days.

(21) Appl. No.: 09/905,369

(22) Filed: Jul. 13, 2001

(65) Prior Publication Data

US 2002/0051949 A1 May 2, 2002

(30) Foreign Application Priority Data

Jul. 19, 2000 (JP) ..... 2000-218979

(51) Int. Cl.[7] ..... G03C 1/09
(52) U.S. Cl. ..... 430/569; 430/567
(58) Field of Search ..... 430/567, 569

(56) References Cited

U.S. PATENT DOCUMENTS 5,252,451 A * 10/1993 Bell ..... 430/567
5,320,938 A 6/1994 House et al.
5,474,888 A * 12/1995 Bell ..... 430/567
5,783,373 A 7/1998 Mydlarz et al.
5,783,378 A * 7/1998 Mydlarz et al. ..... 430/567
6,159,679 A * 12/2000 Vandenbroucke ..... 430/605
6,194,133 B1 * 2/2001 Sato ..... 430/567
6,214,532 B1 * 4/2001 Bollen ..... 430/569
6,352,823 B1 * 3/2002 Sato ..... 430/605
6,372,419 B1 * 4/2002 Inaba ..... 430/567
6,395,463 B1 * 5/2002 Edwards ..... 430/512
6,432,627 B1 * 8/2002 Yamashita ..... 430/619

FOREIGN PATENT DOCUMENTS

EP 1 033 616 A1 9/2000

* cited by examiner

*Primary Examiner*—Janet Baxter
*Assistant Examiner*—Amanda C. Walke
(74) *Attorney, Agent, or Firm*—Frishauf, Holtz, Goodman & Chick, P.C.

(57) ABSTRACT

A silver halide emulsion is disclosed, comprising silver halide grains having a chloride content of not less than 90 mol % and internally doped with an iridium compound (A) and a compound (B) forming a stronger electron trap than said iridium compound (A), the silver halide grains meeting the following requirement:

$$10<X<1000 \text{ and } 0<Y\leqq X$$

wherein X represents an average number of molecules of said iridium compound (A) contained per grain and Y represents an average number of molecules of said compound (B) contained per grain.

13 Claims, No Drawings

SILVER HALIDE EMULSION

FIELD OF THE INVENTION

The present invention relates to silver halide color photographic light sensitive materials capable of invariably producing prints having stable high quality, irrespective of the conventional analog exposure system or the recent digital exposure system, and a planar exposure system or a scanning exposure system, and in particular to silver halide color photographic print materials exhibiting minimized variation in contrast over a wide exposure time range of $10^{-6}$ to 100 sec and superior latent image stability over the period after being exposed and before being processed.

BACKGROUND OF THE INVENTION

Silver halide photographic light sensitive materials (hereinafter, also referred to as photographic light sensitive materials or simply as photographic materials) exhibiting superior advantages to other photosensitive materials, such as high sensitivity and superior tone reproduction, are broadly used today.

However, along with the recent tendency of rapid digitization, there have been increased opportunities of conducting a digital system exposure using laser lights for photographic materials. With such a trend, suitability for high intensity exposure for an ultra-short period of miliseconds to nano-second levels and suitability for scanning exposure are desired for color paper as photographic materials used for color prints. Further, in view of the rapid advancement of non-silver output media such as an ink-jet recording system is strongly required development of photographic materials exhibiting superiorities in image quality, cost and mass-productivity.

Silver chloride emulsions or high chloride silver halide emulsions have been employed for color paper as a means for achieving rapid access. It is well known that a technique of doping iridium compounds is effective for improving the reciprocity law failure characteristic which is an inherent problem of silver halide emulsions. However, it has been proved that when shortening the processing time and an improvement of the reciprocity law failure characteristic are accomplished by such a technique, variation in photographic performance during the period of exposure to processing, i.e., deterioration in so-called latent image stability resulted. Various attempts for improving such a problem have been made so far but a means for overcoming sufficiently such a problem has not yet found out. Specifically in recent problems involved in suitability for exposure to high intensity light for a ultra-short period of time through a digital exposure system, sufficiently acceptable performance in practical use was not achieved only by commonly known techniques for improving reciprocity law failure.

As prior art regarding these, U.S. Pat. No. 4,933,272 discloses a technique in which the use of a face-centered cubic lattice silver halide emulsion occluding a complex comprising a metal selected from groups 5 to 10 inclusive of the periodical table of elements and a nitrosyl or thionitrosyl ligand resulted in an improvement in reciprocity law failure, leading to high contrast images. Similar techniques are disclosed in JP-A Nos. 6-235992, 6-235993, 6-235994 and 6-242539, thereby leading to high contrast characteristics (hereinafter, the term, JP-A refers to an unexamined and published Japanese Patent Application). Further, JP-A Nos. 8-179454, 8-211529 and 8-211530 also disclose a similar technique, in which iridium compounds are used in combination with the foregoing techniques, thereby increasing a contrast in the toe portion and leading to high contrast images. Similarly, JP-A 10-307357 teaches that a compound forming a deep permanent electron trap is allowed to be included in the interior of silver halide grains, leading to a high contrast silver halide emulsion.

However such techniques are mainly intended to achieve high contrast and nothing is taught therein with respect to improvements in reciprocity law failure characteristics over a wide range of exposure and latent image stability, as intended in the present invention.

Other technique applicable to the digital exposure system include, for example, chemical and spectral sensitization suited for formation of a bromide-localized phase, as described in U.S. Pat. No. 4,601,513 and the use of silver iodochloride emulsions, as described in European Patent Nos. 750,222 and 772,079.

Studies have been made by the inventors of this application, with intention of providing a low-priced print outputting material achieving invariably stable photographic performance, irrespective of an exposure system such as an analog system or digital system, exhibiting superior latent image stability and it was proved that the foregoing prior art was insufficient to achieve such an objective. It was unexpected from the prior art and surprising that the foregoing objective was achieved in the embodiments of the present invention.

SUMMARY OF THE INVENTION

Accordingly, it is an object of the present invention to provide a silver halide color photographic light sensitive material capable of invariably producing prints of stable high quality, irrespective of the conventional analog exposure system or the recent digital exposure system as well as a planar exposure system or a scanning exposure system. In particular, it is to provide a silver halide emulsion exhibiting minimal variation in contrast over a wide exposure time range of $10^{-6}$ to 100 sec and superior latent image stability over the period after being exposed and before being processed, and a silver halide photographic material containing the emulsion and an image forming process by scanning exposure of the photographic material.

As a result of the inventors' extensive study aimed to overcome the foregoing problems, the above-described objects are achieved through the following constitution:

a silver halide emulsion comprising silver halide grains having a chloride content of not less than 90 mol %, wherein the silver halide grains each contain an iridium compound (A) and a compound (B) which functions as an electron trap stronger than that of the compound (A) when the compound (B) is doped under the same condition as compound (A); the silver halide grains satisfying the following requirement:

$$10<X<1000 \text{ and } 0<Y\leq X$$

wherein X represents an average number of molecules of the iridium compound (A) contained per grain and Y represents an average number of molecules of the compound (B) contained per grain; and A silver halide emulsion comprising silver halide grains, wherein the silver halide grains each have a chloride content of not less than 90 mol % and are internally doped with an iridium compound (A), a compound (B) forming a stronger electron trap than said iridium compound (A) and a compound (C) comprising a metal selected from group 8 of the periodical table of elements except for iridium and at least an CN ligand; the silver halide grains satisfying the following requirement:

$$100<Z/Y<10000$$

wherein Y represents an average number of molecules of said compound (B) contained per grain and Z represents an average number of molecules of said compound (C) contained per grain.

Suitable means for solving the problems and embodiments of the invention preferably achieve the objects of the invention.

DETAILED DESCRIPTION OF THE INVENTION

One feature of the silver halide emulsion relating to the invention (also denoted as an emulsion according to the invention or the inventive emulsion) is a silver halide emulsion having a relatively high chloride content, a so-called high chloride-containing silver halide emulsion. Specifically, a high chloride silver halide grain emulsion having a chloride content of 90 mol % or more is preferred, which may be any of halide compositions, including silver chloride, silver bromochloride, silver iodobromochloride and silver iodochloride. Of these preferred is silver bromchloride or silver iodochloride having a chloride content of not less than 97 mol %. A silver halide emulsion having a chloride content of 98 to 99.9 mol % is more preferred in terms of rapid processability and process stability.

One of the preferred embodiments of the inventive emulsions is a silver halide emulsion comprised of silver halide grains containing a high bromide silver halide portion. In such cases, the high bromide portion may be epitaxially deposited on the silver halide grain, may form a so-called core-shell structure, or may be present in the form of a region different in halide composition, without forming a complete layer structure. The composition may vary continuously or discontinuously. The high bromide portion is preferably localized in the corners or in both the corners and edges on the silver halide grain surface.

Silver iodochloride grains internally containing a trace amount of iodide are also preferred, in which the iodide containing region is preferably localized in a narrow region near the grain surface.

One feature of the silver halide grains of the invention concerns doping the iridium compound (A), i.e., iridium atom-containing compound. The iridium compound (A) is preferably a six-coordinate complex and an iridium compound containing at least a halogen atom as a ligand is specifically preferred. Exemplary examples of the iridium compound are shown below but are by no means limited to these. The iridium compounds may be used in combination thereof.

| | |
|---|---|
| A-1: $K_2[IrCl_6]$ | A-2: $K_3[IrCl_6]$ |
| A-5: $K_2[Ir(NO)Cl_5]$ | A-6: $K_3[Ir(NO)Cl_5]$ |
| A-7: $K_2[IrBr_6]$ | A-8: $K_3[IrBr_6]$ |
| A-9: $Na_2[IrBr_6]$ | A-10: $Na_3[IrBr_6]$ |
| A-11: $K_2[IrBr_4Cl_2]$ | A-12: $K_3[IrBr_4Cl_2]$ |
| A-13: $K_2[IrBr_3Cl_3]$ | A-14: $K_3[IrBr_3Cl_3]$ |
| A-15: $K_2[IRBr_5Cl]$ | A-16: $K_3[IrBr_5Cl]$ |
| A-17: $K_2[IrBr_5I]$ | A-18: $K_3[IrBr_5I]$ |
| A-19: $K_2[IrBr_5(H_2O)]$ | A-20: $K_3[IrBr_5(H_2O)]$ |

In silver halide emulsion grains according to the invention, iridium compound (A) is doped together with compound (B). This compound (B) is capable of forming a strong electron trap relative to iridium compound (A) when compound (B) is singly doped in the same grain and under the same condition as compound (A). Herein, the compound forming a stronger electron trap than the iridium compound (A) when each of both compounds is doped in the same grain and under the same condition can be judged based on the feature meeting any one of the following conditions 1 through 5, relative to compound (A):

1. a compound exhibiting an effect of lowering the intensity of a microwave photoconduction signal intensity relative to the compound (A) when doped under the same condition;
2. a compound exhibiting an effective of decreasing the decay time of the microwave photoconduction signal intensity when doped under same condition;
3. a compound forming a deep electron trap relative to compound (A) when doped under the same condition;
4. a compound forming a trap capable of holding a trapped electron for a long time relative to compound (A) when doped under the same condition;
5. a compound exhibiting an effect of reducing photographic sensitivity at a density of 1.0 on a characteristic curve by 0.2 log E or more relative to compound (A).

Of the foregoing compounds meeting conditions 1 through 5, compounds meeting conditions 1 through 3 are preferred. Metal compounds usable with such an intention as a compound (B) depends on the compound (A) but preferably is a compound represented by the following formula [II]:

$$R_n[MX_mY_{6-m}] \qquad \text{formula [II]}$$

wherein M is a metal selected from Group 8 of the periodical table, preferably iron, cobalt, ruthenium, rhodium, osmium, nickel, palladium or iridium, and more preferably ruthenium, rhodium or osmium; R is an alkali metal, and preferably sodium or potassium; m is an integer of 0 to 6 and n is 2 or 3; X and Y are each a ligand of the metal complex and preferably nitrosyl, thionitrosyl or carbonyl group, and a part or all of the ligands are preferably halide ions. Exemplary examples of the preferred compound (B) are shown below but the compound (B) depends on the selected compound (A). The compound (B) is not limited to these examples and may be used in combination as long as it meets the foregoing requirement.

| | |
|---|---|
| B-1: $K_2[RuCl_6]$ | B-2: $K_2[PtCl_6]$ |
| B-3: $K_2[Pt(SCN)_4]$ | B-4: $K_2[NiCl_4]$ |
| B-5: $K_2[PdCl_6]$ | B-6: $K_3[RhCl_6]$ |
| B-7: $K_2[OsCl_6]$ | B-8: $K_2[ReCl_6]$ |
| B-9: $K_3[RhBr_6]$ | B-10: $K_3[Mo(OCN)_6]$ |
| B-11: $K_3[Re(CNO)_6]$ | B-12: $K_4[Ru(CNO)_6]$ |
| B-13: $K_4[Fe(CNO)_6]$ | B-14: $K_2[Pt(CNO)_4]$ |
| B-15: $K_3[Co(NH_3)_6]$ | B-16: $K_5[Co_2(CNO)_{11}]$ |
| B-17: $K_3[Re(CNO)_6]$ | B-18: $K_4[Os(CNO)_6]$ |
| B-19: $Cs_2[Os(NO)Cl_5]$ | B-20: $K_2[Ru(NO)Cl_5]$ |
| B-21: $K_2[Ru(CO)Cl_5]$ | B-22: $Cs_2[Os(CO)Cl_5]$ |
| B-23: $K_2[Fe(NO)Cl_5]$ | B-24: $K_2[Ru(NO)Br_5]$ |
| B-25: $K_2[Ru(NO)I_5]$ | B-26: $K_2[Re(NO)Br_5]$ |
| B-27: $K_2[Re(NO)Cl_5]$ | B-28: $K_2[Ir(NO)Cl_5]$ |
| B-29: $K_2[Ru(NS)Cl_5]$ | B-30: $K_2[Os(NS)Br_5]$ |
| B-31: $K_2[Ru(NS)Br_5]$ | B-32: $K_2[Ru(NS)(SCN)_5]$ |

The amount of compound (A) or compound (B) to be contained is defined as the number of molecules per silver halide grain. In this case, the method for allowing the compound to be contained refers to a doping method of allowing the objective compound to be contained in the interior of silver halide crystal during formation of the silver halide crystal, which is definitely distinguishable from the method of allowing the objective compound to adsorb onto the crystal surface to be contained.

The amount of the compound to be internally contained for doping (hereinafter, such a compound is denoted as a dopant), i.e., the doping amount involves either "an amount added, as prescribed" to dope an intended amount of the dopant, or "an amount actually doped" within the grain and both amounts are not necessarily the same. In cases where the relationship between the amount of dopant and performance of the doped grain emulsion is discussed, the use of the latter amount is preferred but it is not at all easy to definitely determine its net value. In the invention, in cases where it is described simply as a doping amount, it means the amount to be doped, as prescribed.

The doping amount is conventionally represented in terms of molar quantity per mole of silver. As is of common practice, silver halide emulsion grains are designed to be of various grain sizes to achieve intended photographic performance. In the case of emulsions containing the same molar quantity of silver halide grains, the average grain size is the larger, the fewer the number of the grains and the smaller average grain size results in a larger number of the grains. Accordingly, in case where the doping amount is represented by the molar quantity per mole of silver halide, even if the doping amount is the same, the dopant quantity per grain is variable with the average grain size. As a result of the inventors' study, it was proved that performance of the emulsion was substantially concerned with the quantity of dopants contained in the grain and that to achieve the desired effects of the invention, it was necessary to represent the doping amount in terms of an average value of the number of dopant molecules per silver halide grain.

The average number of molecules doped per silver halide grain can be determined in the following manner. From the average grain size of a prescribed molar quantity of silver halide grains contained in an emulsion is determined the average grain volume, from which the number of silver atoms per grain can be calculated. In this case, the lattice constant of silver halide grains of the invention, containing 90 mol % or more chloride are approximated to be substantially equivalent to that of a silver chloride crystal. Further, from the molar quantity of the dopant contained in the emulsion, per mol of silver halide and its ratio to the number of silver atoms obtained above, the average number of molecules of the dopant per grain is determined.

The thus obtained average number of molecules of compound (A) per grain, X meets the requirement of $10<X<1000$ to achieve the effects of the invention. In cases of X being less than 10, improvements at the time of high intensity exposure are not achieved and cases of X being greater than 1000 often result in deteriorated latent image stability. Further, the average number of molecules of compound, (B) per grain, Y meets the requirement of $0<Y\leqq X$. No effect of the invention can be obtained at Y of zero and reduction in sensitivity occurs at Y greater than X to levels unacceptable for practical use. To achieve enhanced effects of the invention, $20<X<200$ and $10\leqq Y\leqq X$ is preferred.

Iridium compound (A) and compound (B) may be doped in the same region or different regions within the grain, and compound (B) is not localized in the region closer to the surface than compound (A). In one preferred embodiment of the invention, iridium compound (A) and compound (B) are contained together within a single silver halide, forming at least three regions comprised of the region containing iridium compound (A), the region containing compound (B) and the region containing neither iridium compound (A) nor compound (B). Preferably, compound (A) and compound (B) are so doped that the region containing iridium compound (A) and the region containing compound (B) each account for at least 10% of the grain volume. Specifically, the iridium compound is preferably distributed in a relatively broad region at a relatively low concentration. The distribution concentration may locally be varied and the maximum doping concentration of iridium compound (A) is preferably not more than $10^{-6}$ mol per mol of silver halide.

In another preferred embodiment of the invention, compound (C) of a metal selected from group 8 of the periodical table of elements, except for iridium and containing a CN ligand is contained within the silver halide grain, together with the iridium compound (A) and compound (B). Such a compound (C) is preferably represented by the following formula (III):

$$R_n[M(CN)_mZ_{6-m}] \qquad \text{formula (III)}$$

wherein M is a metal selected from group 8 of the periodical table of elements, except for iridium (preferably iron, cobalt, ruthenium, rhodium, osmium, nickel, or palladium, and more preferably iron or ruthenium); R is an alkali metal, (and preferably sodium or potassium); m is an integer of 1 to 6 and n is 2, 3 or 4; and Z represents a ligand of the metal complex and a compound in which a part or all of the ligand is a halide ion is also preferred. Exemplary examples of the preferred compound (C) are shown below but the compound (C) is not limited to these examples and may be used in combination as long as it meets the foregoing requirement.

| | |
|---|---|
| C-1: $K_4[Fe(CN)_6]$ | C-2: $K_3[Fe(CN)_6]$ |
| C-3: $K_4[Ru(CN)_6]$ | C-4: $K_2[RuBr(CN)_5]$ |
| C-5: $K_4[Os(CN)_6]$ | C-6: $K_2[Os(NS)(CN)_5]$ |
| C-7: $K_4[Re(CN)_6]$ | C-8: $K_2[ReCl(CN)_5]$ |

Similarly to compound (A) or compound (B), the amount of compound (C) containing a CN ligand to be contained is defined in the number of molecules per silver halide grain.

The average number of molecules of compound (C) per grain, Z and the average number of molecules of compound (B) per grain, Y meets the requirement of $100<Z/Y<10000$ to achieve the effects of the invention. In the case of Z/Y being less than 100, improvements at the time of high intensity exposure are often achieved and the X being greater than 10000 often results in deteriorated latent image stability. It is preferred that the CN ligand-containing compound (C) not be doped within the region of 10% of the grain volume from the grain surface.

In one preferred embodiment of the invention, iridium compound (A) is contained in the same region as the compound (C), or in the region on the grain surface side (i.e., external to compound (C)), and compound (B) is contained in the same region as compound (C).

Silver halide grains relating to the invention may be of any form so long as having a high chloride composition. One of preferred grain forms is cubic grains having a (100) crystal surface. Octahedral, tetradecahedral or dodecahedral grains, which can be prepared according to methods described in U.S. Pat. Nos. 4,183,756 and 4,225,666, JP-A No. 55-26589 and JP-B No. 55-42737 (hereinafter, the term, JP-B refers to published Japanese Patent), and J. Photogr. Sci. 21, 39 (1973) are also usable. Silver halide twinned crystal grains may be used. Silver halide grains having a single form are preferred and it is specifically preferred that at least two kinds of monodisperse grain emulsions be included in the same layer.

Silver halide grains used in the invention are not limited with respect to grain size but the grain size is preferably 0.1 to 1.2 $\mu$m, and more preferably 0.2 to 1.0 $\mu$m in terms of rapid processability and sensitivity. The grain size can be determined in terms of grain projected area or a diameter-approximated value (e.g., equivalent sphere diameter, i.e., a diameter of a sphere having a volume equivalent to the grain volume). In the case of grains having a substantially uniform shape, the grain size distribution can be definitely represented by the grain diameter or grain projected area. With regard to the grain size distribution is preferred monodisperse silver halide grains having a coefficient of variation of 0.05 to 0.22, and more preferably 0.05 to 0.15. It is specifically preferred that at least two kinds of monodisperse grain emulsions having a coefficient of variation of 0.05 to 0.15 be included in the same layer. The coefficient of variation is referred to as a coefficient representing a width of the grain size distribution and defined according to the following equation:

$$\text{Coefficient of variation}=S/R$$

where S is a standard deviation of grain size distribution and R is a mean grain size. Herein, the grain size is a diameter in the case of spherical grain, and in the case of being cubic, or shape other than spherical form, the grain size is a diameter of a circle having an area equivalent to the grain projected area.

There can be employed a variety of apparatuses and methods for preparing silver halide emulsions, which are generally known in the art. The silver halide can be prepared according to any of acidic precipitation, neutral precipitation and ammoniacal precipitation. Silver halide grains can formed through a single process, or through forming seed grains and growing them. A process for preparing seed grains and a growing process thereof may be the same with or different from each other.

Normal precipitation, reverse precipitation, double jet precipitation or a combination thereof is applicable as a reaction mode of a silver salt and halide salt, and the double jet precipitation is preferred. As one mode of the double jet precipitation is applicable a pAg-controlled double jet method described in JP-A 54-48521. There can be employed a apparatus for supplying a silver salt aqueous solution and a halide aqueous solution through an adding apparatus provided in a reaction mother liquor, as described in JP-A 57-92523 and 57-92524; an apparatus for adding silver salt and halide solutions with continuously varying the concentration thereof, as described in German Patent 2,921,164; and an apparatus for forming grains in which a reaction mother liquor is taken out from the reaction vessel and concentrated by ultra-filtration to keep constant the distance between silver halide grains.

Solvents for silver halide such as thioethers are optionally employed. A compound containing a mercapto group, nitrogen containing heterocyclic compound or a compound such as a sensitizing dye can also be added at the time of forming silver halide grains or after completion thereof.

In the silver halide emulsion of the invention, sensitization with a gold compound and sensitization with a chalcogen sensitizer can be employed in combination. The chalcogen sensitizer include a sulfur sensitizer, selenium sensitizer and tellurium sensitizer and of these is preferred the sulfur sensitizer. Exemplary examples of sulfur sensitizers include thiosulfates, triethylthiourea, allylthiocarbamide, thiourea, allylisothiocyanate, cystine, p-toluenethiosulfonate, rhodanine, and sulfur single substance. The amount of the sulfur sensitizer to be added to a silver halide emulsion layer, depending of the kind of a silver halide emulsion and expected effects, is preferably $5\times10^{-10}$ to $5\times10^{-5}$, and more preferably $5\times10^{-9}$ to $3\times10^{-6}$ mole per mole of silver halide. In cases where added to a layer other than a silver halide emulsion layer, the amount is preferably $1\times10^{-9}$ to $1\times10^{-3}$ mole/m$^2$. The gold sensitizer such as chloroauric acid or gold sulfide is added in the form of a complex. Compounds, such as dimethylrhodanine, thiocyanic acid, mercaptotetrazole and mercaptotriazole are used as a ligand. The amount of the gold compound to be added, depending of the kind of a silver halide emulsion, the kind of the compound and ripening conditions, is preferably $1\times10^{-8}$ to $1\times10^{-4}$, and more preferably $1\times10^{-8}$ to $1\times10^{-5}$ mole per mole of silver halide. Silver halide emulsions used in the invention may be chemically sensitized by reduction sensitization.

A antifoggant or a stabilizer known in the art are incorporated into the photographic material, for the purpose of preventing fog produced during the process of preparing the photographic material, reducing variation of photographic performance during storage or preventing fog produced in development. Examples of preferred compounds for the purpose include compounds represented by formula (II) described in JP-A 2-146036 at page 7, lower column. These compounds are added in the step of preparing a silver halide emulsion, the chemical sensitization step or during the course of from completion of chemical sensitization to preparation of a coating solution. In cases when chemical sensitization is undergone in the presence of these compounds, the amount thereof is preferably $1\times10^{-5}$ to $5\times10^{-4}$ mole per mole of silver halide. In cases when added after chemical sensitization, the amount thereof is preferably $1\times10^{-6}$ to $1\times10^{-2}$, and more preferably $1\times10^{-5}$ to $5\times10^{-3}$ mol per mole of silver halide. In cases when added at the stage of preparing a coating solution, the amount is preferably $1\times10^{-6}$ to $1\times10^{-1}$, and more preferably $1\times10^{-5}$ to $1\times10^{-2}$ mole per mol of silver halide. In case where added to a layer other than a silver halide emulsion layer, the amount is preferably $1\times10^{-9}$ to $1\times10^{-3}$ mole/m$^2$.

There are employed dyes having absorption at various wavelengths for anti-irradiation and anti-halation in the photographic material relating to the invention. A variety of dyes known in the art can be employed, including dyes having absorption in the visible range described in JP-A 3-251840 at page 308, AI-1 to 11, and JP-A 6-3770; infrared absorbing dyes described in JP-A 1-280750 at page 2, left lower column, formula (I), (II) and (III). These dyes do not adversely affect photographic characteristics of a silver halide emulsion and there is no stain due to residual dyes. For the purpose of improving sharpness, the dye is preferably added in an amount that gives a reflection density at 680 nm of not less than 0.7 and more preferably not less than 0.8.

Fluorescent brightening agents are also incorporated into the photographic material to improve whiteness. Examples of preferred compounds include those represented by formula II described in JP-A 2-232652.

In cases when a silver halide photographic light sensitive material according to the invention is employed as a color photographic material, the photographic material comprises layer(s) containing silver halide emulsion(s) which are spectrally sensitized in the wavelength region of 400 to 900 nm, in combination with a yellow coupler, a magenta coupler and a cyan coupler. The silver halide emulsion contains one or more kinds of sensitizing dyes, singly or in combination thereof.

In the silver halide emulsions can be employed a variety of spectral-sensitizing dyes known in the art. Compounds BS-1 to 8 described in JP-A 3-251840 at page 28 are preferably employed as a blue-sensitive sensitizing dye. Compounds GS-1 to 5 described in JP-A 3-251840 at page 28 are preferably employed as a green-sensitive sensitizing dye. Compounds RS-1 to 8 described in JP-A 3-251840 at page 29 are preferably employed as a red-sensitive sensitizing dye. In cases where exposed to infra-red ray with a semiconductor laser, infrared-sensitive sensitizing dyes are employed. Compounds IRS-1 to 11 described in JP-A 4-285950 at pages 6-8 are preferably employed as a blue-sensitive sensitizing dye. Supersensitizers SS-1 to SS-9 described in JP-A 4-285950 at pages 8–9 and compounds S-1 to S-17 described in JP-A 5-66515 at pages 5–17 are preferably included, in combination with these blue-sensitive, green-sensitive and red-sensitive sensitizing dyes. The sensitizing dye is added at any time during the course of silver halide grain formation to completion of chemical sensitization. The sensitizing dye is incorporated through solution in water-miscible organic solvents such as methanol, ethanol, fluorinated alcohol, acetone and dimethylformamide or water, or in the form of a solid particle dispersion.

As couplers used in silver halide photographic materials relating to the invention is usable any compound capable of forming a coupling product exhibiting an absorption maximum at the wavelength of 340 nm or longer, upon coupling with an oxidation product of a developing agent. Representative examples thereof include yellow dye forming couplers exhibiting an absorption maximum at the wavelength of 350 to 500 nm, magenta dye forming couplers exhibiting an absorption maximum at the wavelength of 500 to 600 nm and cyan dye forming couplers exhibiting an absorption maximum at the wavelength of 600 to 750 nm.

Examples of preferred cyan couplers include those which are represented by general formulas (C-I) and (C-II) described in JP-A 4-114154 at page 5, left lower column. Exemplary compounds described therein (page 5, right lower column to page 6, left lower column) are CC-1 to CC-9.

Examples of preferred magenta couplers include those which are represented by general formulas (M-I) and (M-II) described in JP-A 4-114154 at page 4, right upper column. Exemplary compounds described therein (page 4, left lower column to page 5, right upper column) are MC-1 to MC-11. Of these magenta couplers are preferred couplers represented by formula (M-I) described in ibid, page 4, right upper column; and couplers in which RM in formula (M-I) is a tertiary alkyl group are specifically preferred. Further, couplers MC-8 to MC-11 are superior in color reproduction of blue to violet and red, and in representation of details.

Examples of preferred yellow couplers include those which are represented by general formula (Y-I) described in JP-A 4-114154 at page 3, right upper column. Exemplary compounds described therein (page 3, left lower column) are YC-1 to YC-9. Of these yellow couplers are preferred couplers in which RY1 in formula (Y-I) is an alkoxy group are specifically preferred or couplers represented by formula [I] described in JP-A 6-67388. Specifically preferred examples thereof include YC-8 and YC-9 described in JP-A 4-114154 at page 4, left lower column and Nos. (1) to (47) described in JP-A 6-67388 at pages 13–14. Still more preferred examples include compounds represented by formula [Y-1] described in JP-A 4-81847 at page 1 and pages 11–17.

When an oil-in-water type-emulsifying dispersion method is employed for adding couplers and other organic compounds used for the photographic material of the present invention, in a water-insoluble high boiling organic solvent, whose boiling point is 150° C. or more, a low boiling and/or a water-soluble organic solvent are combined if necessary and dissolved. In a hydrophilic binder such as an aqueous gelatin solution, the above-mentioned solutions are emulsified and dispersed by the use of a surfactant. As a dispersing means, a stirrer, a homogenizer, a colloidal mill, a flow jet mixer and a supersonic dispersing machine may be used. Preferred examples of the high boiling solvents include phthalic acid esters such as dioctyl phthalate, diisodecyl phthalate, and dibutyl phthalate; and phosphoric acid esters such as tricresyl phosphate and trioctyl phosphate. High boiling solvents having a dielectric constant of 3.5 to 7.0 are also preferred. These high boiling solvents may be used in combination. Instead of or in combination with the high boiling solvent is employed a water-insoluble and organic solvent-soluble polymeric compound, which is optionally dissolved in a low boiling and/or water-soluble organic solvent and dispersed in a hydrophilic binder such as aqueous gelatin using a surfactant and various dispersing means. In this case, examples of the water-insoluble and organic solvent-soluble polymeric compound include poly(N-t-butylacrylamide).

As a surfactant used for adjusting surface tension when dispersing or coating photographic additives, the preferable compounds are those containing a hydrophobic group having 8 through 30 carbon atoms and a sulfonic acid group or its salts in a molecule. Exemplary examples thereof include A-1 through A-11 described in JP-A No. 64-26854. In addition, surfactants, in which a fluorine atom is substituted to an alkyl group, are also preferably used. The dispersion is conventionally added to a coating solution containing a silver halide emulsion. The elapsed time from dispersion until addition to the coating solution and the time from addition to the coating solution until coating are preferably short. They are respectively preferably within 10 hours, more preferably within 3 hours and still more preferably within 20 minutes.

To each of the above-mentioned couplers, to prevent color fading of the formed dye image due to light, heat and humidity, an anti-fading agent may be added singly or in combination. The preferable compounds or a magenta dye are phenyl ether type compounds represented by Formulas I and II in JP-A No. 2-66541, phenol type compounds represented by Formula IIIB described in JP-A No. 3-174150, amine type compounds represented by Formula A described in JP-A No. 64-90445 and metallic complexes represented by Formulas XII, XIII, XIV and XV described in JP-A No. 62-182741. The preferable compounds to form a yellow dye and a cyan dye are compounds represented by Formula I' described in JP-A No. 1-196049 and compounds represented by Formula II described in JP-A No. 5-11417.

A compound (d-11) described in JP-A 4-114154 at page 9, left lower column and a compound (A'-1) described in the same at page 10, left lower column are also employed for allowing the absorption wavelengths of a dye to shift. Besides can also be employed a compound capable of releasing a fluorescent dye described in U.S. Pat. No. 4,774,187.

It is preferable that a compound reacting with the oxidation product of a color developing agent be incorporated into a layer located between light-sensitive layers for preventing color staining and that the compound is added to the silver halide emulsion layer to decrease fogging. As a compound for such purposes, hydroquinone derivatives are preferable, and dialkylhydroquinone such as 2,5-di-t-octyl hydroquinone are more preferable. The specifically preferred compound is a compound represented by Formula II described in JP-A No. 4-133056, and compounds II-1 through II-14 described in the above-mentioned specification pp. 13 through 14 and compound 1 described on page 17.

In the photographic material according to the present invention, it is preferable that static fogging is prevented and light-durability of the dye image is improved by adding a UV absorber. The preferable UV absorbent is benzotriazoles. The specifically preferable compounds are those represented by Formula III-3 in JP-A No. 1-250944, those represented by Formula III described in JP-A No. 64-66646, UV-1L through UV-27L described in JP-A No. 63-187240, those represented by Formula I described in JP-A No. 4-1633 and those represented by Formulas (I) and (II) described in JP-A No. 5-165144.

In the photographic materials used in the invention is advantageously employed gelatin as a binder. Furthermore, there can be optionally employed other hydrophilic colloidal materials, such as gelatin derivatives, graft polymers of gelatin with other polymers, proteins other than gelatin, saccharide derivatives, cellulose derivatives and synthetic hydrophilic polymeric materials. A vinylsulfone type hardening agent or a chlorotriazine type hardening agent is employed as a hardener of the binder, and compounds described in JP-A 61-249054 and 61-245153 are preferably employed. An antiseptic or antimold described in JP-A 3-157646 is preferably incorporated into a hydrophilic colloid layer to prevent the propagation of bacteria and mold which adversely affect photographic performance and storage stability of images. A lubricant or a matting agent is also preferably incorporated to improve surface physical properties of raw or processed photographic materials.

A variety of supports are employed in the photographic material used in the invention, including paper coated with polyethylene or polyethylene terephthalate, paper support made from natural pulp or synthetic pulp, polyvinyl chloride sheet, polypropylene or polyethylene terephthalate supports which may contain a white pigment, and baryta paper. Of these supports a paper support coated, on both sides, with water-proof resin layer. As the water-proof resin are preferably employed polyethylene, ethylene terephthalate and a copolymer thereof. Inorganic and/or organic white pigments are employed, and inorganic white pigments are preferably employed. Examples thereof include alkaline earth metal sulfates such as barium sulfate, alkaline earth metal carbonates such as calcium carbonate, silica such as fine powdery silicate and synthetic silicate, calcium silicate, alumina, alumina hydrate, titanium oxide, zinc oxide, talc, an d clay. Preferred examples of white pigments include barium sulfate and titanium oxide. The amount of the white pigment to be added to the water-proof resin layer on the support surface is preferably not less than 13% by weight, and more preferably not less than 15% by weight to improve sharpness. The dispersion degree of a white pigment in the water-proof resin layer of paper support can be measured in accordance with the procedure described in JP-a 2-28640. In this case, the dispersion degree, which is represented by a coefficient of variation is preferably not more than 020, and more preferably not more than 0.15.

Supports having a center face roughness (Sra) of 0.15 nm or less (preferably, 0.12 nm or less) are preferably employed in terms of glossiness. Trace amounts of a blueing agent or reddening agent such as ultramarine or oil-soluble dyes are incorporated in a water-proof resin layer containing a white pigment or hydrophilic layer(s) of a reflection support to adjust the balance of spectral reflection density in a white portion of processed materials and improve its whiteness. The surface of the support may be optionally subjected to corona discharge, UV light exposure or flame treatment and further thereon, directly or through a sublayer (i.e., one or more sublayer for making improvements in surface properties of the support, such as adhesion property, antistatic property, dimensional stability, friction resistance, hardness, anti halation and/or other characteristics), are coated component layers of the photographic material relating to the invention. In coating of the photographic material, a thickening agent may be employed to enhance coatability of a coating solution. As a coating method are useful extrusion coating and curtain coating, in which two or more layers are simultaneously coated.

To form photographic images using a photographic material relating to the invention, an image recorded on the negative can optically be formed on a photographic material to be printed. Alternatively, the image is converted to digital information to form the image on a CRT (anode ray tube), and the resulting image can be formed on a photographic material to be printed by projecting or scanning with varying the intensity and/or exposing time of laser light, based on the digital information.

It is preferable to apply the present invention to a photographic material wherein a developing agent is not incorporated in the photographic material.

Commonly known aromatic primary amine developing agents are employed in the invention. Examples thereof include:

CD-1) N,N-diethyl-p-phenylendiamine,
CD-2) 2-amino-5-diethylaminotoluene,
CD-3) 2-amino-5-(N-ethyl-N-laurylamino)toluene,
CD-4) 4-(N-ethyl-N-(β-hydroxyethyl)amino)-aniline,
CD-5) 2-methyl-4-(N-ethyl-N-(β-hydroxyethyl)amino) aniline,
CD-6) 4-amino-3-methyl-N-ethyl-N-(β-methanesulfoneamidoethyl)aniline,
CD-7) N-(2-amino-5-diethylaminophenylethyl)-methanesulfonamide,
CD-8) N,N-dimethyl-p-phenylenediamine,
CD-9) 4-amino-3-methyl-N-ethyl-N-metoxyethylaniline,
CD-10) 4-amino-3-methyl-N-ethyl-N-(β-ethoxyethyl) aniline,
CD-11) 4-amino-3-methyl-N-ethyl-N-(γ-hydroxypropyl)-aniline.

The pH of a color developing solution is optional, but preferably 9.5 to 13.0, and more preferably 9.8 to 12.0 in terms of rapid access. The higher color development temperature enables more rapid access, but the temperature is preferably 35 to 70° C., and more preferably 37 to 60° C. in terms of stability of processing solutions. The color developing time is conventionally 3 min. 30 sec. but the developing time in the invention is preferably not longer than 40 sec., and more preferably not longer than 25 sec.

In addition to the developing agents described above, the developing solution is added with commonly known developer component compounds, including an alkaline agent having pH-buffering action, a development inhibiting agent such as chloride ion or benzotriazole, a preservative, and a chelating agent.

In the image forming method according to the invention, photographic materials, after color-developed, may be optionally subjected to bleaching and fixing. The bleaching and fixing may be carried out currently. After fixing, washing is conventionally carried out. Stabilizing may be conducted in place of washing. As a processing apparatus used in the invention is applicable a roller transport type processor in which a photographic material is transported with being nipped by rollers and an endless belt type processor in which a photographic material is transported with being fixed in a belt. Further thereto are also employed a method in which a processing solution supplied to a slit-formed processing bath and a photographic material is transported therethrough, a spraying method, a web processing method by contact with a carrier impregnated with a processing solution and a method by use of viscous processing solution. A large amount of photographic materials are conventionally processed using an automatic processor. In this case, the less replenishing rate is preferred and an environmentally friendly embodiment of processing is replenishment being made in the form of a solid tablet, as described in KOKAI-GIHO (Disclosure of Techniques) 94-16935.

EXAMPLES

The present invention will be further described based on examples but the embodiments of the invention are by no means limited to these. Unless otherwise noted, the percentage (%) in examples means percentage, based on mass weight (or denoted as % by weight).

Example 1

A silver halide emulsion (EMP-101) was prepared according to the following procedure and mixed with an aqueous gelatin solution to form a coating solution having a ratio of gelatin/silver=0.6. A surfactant (SU-2), as a coating aid was added thereto to adjust surface tension. The thus prepared coating solution was coated on 120 $\mu$m thick triacetyl cellulose film so as to have a silver coverage of 1.2 g/m$^2$ to form Sample No. 101 for measurement of microwave photoconductivity.

Preparation of Silver Halide Emulsion (E-1)

To 1 liter of aqueous 2% gelatin solution kept at 40° C. were simultaneously added the following solutions A0 and B0 with maintaining the pAg at 6.5 and the pH at 3.0, and further thereto were added Solutions C0 and D0 with maintaining the pAg at 7.3 and the pH at 5.5., in 120 min. The pAg was controlled by the method described in JP-A 59-45437, and the pH was adjusted using aqueous sulfuric acid or sodium hydroxide solution.

| | |
|---|---|
| Solution A0 | |
| Sodium chloride | 3.45 g |
| Iridium compound (A-1) | $5.88 \times 10^{-10}$ mole |
| Water to make | 200 ml |
| Solution B0 | |
| Silver nitrate | 10.0 g |
| Water to make | 200 ml |
| Solution C0 | |
| Sodium chloride | 103.2 g |
| Iridium compound (A-1) | $1.76 \times 10^{-8}$ mole |
| Water to make | 600 ml |
| Solution D0 | |
| Silver nitrate | 300 g |
| Water to make | 600 ml |

After completing the addition, the resulting emulsion was desalted using a 5% aqueous solution of Demol N (produced by Kao-Atlas) and aqueous 20% magnesium sulfate solution, and mixed with a gelatin aqueous solution to obtain a monodisperse cubic silver chloride grain emulsion (EMP-101) having an average grain size of 0.40 $\mu$m, and a coefficient of variation of grain size of 0.07. The thus prepared emulsion was comprised of cubic silver chloride grains added with iridium compound [A-1, potassium hexachloroiridate (IV)] of $1\times10^{-8}$ mole and having an average edge length of 0.4 $\mu$m.

Emulsions EMP-1-2 through EMP-109 were prepared similarly to EMP-101, provided that the iridium compound was replaced by a metal compound as shown in Table 1. Subsequently, Samples Nos. 102 through 109 were prepare similarly to Sample 101, provided that emulsion EMP-101 was replaced by each of EMP-102 through EMP-109.

Samples 101 through 109 were measured with respect to microwave photoconductivity, and the photoconduction signal intensity in induced absorption and the decay time thereof were determined in accordance with the method describe din JP-A 5-45758 at page 2–3, in which the light source was filter with UVD-33S filter (available from TOSHIBA GLASS Co., Ltd.) and excitation wit UV light was conducted. Results are shown in Table 1. The photoconductivity signal decay time of each sample was represented by a relative value, based on the decay time of Sample 101 being 100.

TABLE 1

| Sample No. | Emulsion | Dopant | Decay Time |
|---|---|---|---|
| 101 | EMP-101 | A-1 $K_2[IrCl_6]$ | 100 |
| 102 | EMP-102 | A-7 $K_2[IrBr_6]$ | 92 |
| 103 | EMP-103 | B-1 $K_2[RuCl_6]$ | 71 |
| 104 | EMP-104 | B-7 $K_2[OsCl_6]$ | 65 |
| 105 | EMP-105 | B-9 $K_3[RhBr_6]$ | 48 |
| 106 | EMP-106 | B-19 $Cs_2[Os(NO)Cl_5]$ | 42 |
| 107 | EMP-107 | B-20 $K_2[Ru(NO)Cl_5]$ | 44 |
| 108 | EMP-108 | C-1 $K_4[Fe(CN)_6]$ | 387 |
| 109 | EMP-109 | C-3 $K_4[Ru(CN)_6]$ | 331 |

As can be seen from Table 1, samples coating with emulsions containing dopant (B-1), (B-7), (B-9), (B-19) or (B-20) exhibited a photoconductivity signal decay time shorter than that of Samples No. 101 or 102 comprising an emulsion doped with iridium compound (A) From such results, it was proved that compound (B-1), (B-7), (B-9), (B-19) or (B-20) had effects of making the photoconductivity signal decay time shorter than iridium compound (A-1) or (A-7) doped under the same condition. It is therefore shown that the compound (B) are capable of functioning as a stronger electron trap than the iridium compound (A) when respective compounds are each doped in silver halide grains under the same condition.

Example 2

There was prepared a paper support laminated, on paper with a weight of 180 g/m$^2$, with high density polyethylene, provided that the side to coat an emulsion layer was laminated with polyethylene melt containing surface-treated anatase type titanium oxide in an amount of 15% by weight. The reflection support was subjected to corona discharge and provided with a gelatin sublayer, and further thereon, the following component layers were provided to prepare a silver halide photographic material.

Coating solutions were prepared according to the following procedure.

1st Layer Coating Solution

To 23.4 g of yellow coupler (Y-1), 3.34 g of dye image stabilizer (ST-1), 3.34 g of dye image stabilizer (ST-2), 3.34 g of dye image stabilizer (ST-5), 0.34 g of antistaining agent (HQ-1), 5.0 g of image stabilizer A, 3.33 g of high boiling organic solvent (DBP) and 1.67 g of high boiling solvent (DNP) was added 60 ml of ethyl acetate. Using a ultrasonic homogenizer, the resulting solution was dispersed in 220 ml of an aqueous 10% gelatin solution containing 7 ml of an aqueous 20% surfactant (SU-1) solution to obtain a yellow coupler dispersion. The obtained dispersion was mixed with the blue-sensitive silver halide emulsion (Em-B) to prepare a 1st layer coating solution. Coating solutions for the 2nd layer to 7th layer were each prepared similarly to the 1st layer coating solution, and each coating solution was coated so as to have a coating amount as shown below.

Hardeners (H-1) and (H-2) were incorporated. There were also incorporated surfactants, (SU-2) and (SU-3) to adjust surface tension. Antiseptic DI-1 was further incorporated. To the 2nd, 3rd, 4th and 6th layers were added anti-irradiation dyes (AI-1, AI-2, and AI-3) and to each layer was a fungicide (F-1) so as to have a total amount of 0.04 /m$^2$.

| Layer | Constitution | Amount (g/m$^2$) |
|---|---|---|
| 7th Layer | Gelatin | 0.70 |
| (Protective layer) | DBP | 0.002 |
| | DIDP | 0.002 |
| | Silicon dioxide | 0.003 |
| 6th Layer | Gelatin | 0.40 |
| (UV absorbing layer) | AI-1 | 0.01 |
| | UV absorbent (UV-1) | 0.07 |
| | UV absorbent (UV-2) | 0.12 |
| | Antistaining agent (HQ-5) | 0.02 |
| 5th Layer | Gelatin | 1.00 |
| (Red-sensitive layer) | Red-sensitive emulsion (Em-R) | 0.17 |
| | Cyan coupler (C-1) | 0.22 |
| | Cyan coupler (C-2) | 0.06 |
| | Dye image stabilizer (ST-1) | 0.06 |
| | Antistaining agent (HQ-1) | 0.003 |
| | DBP | 0.10 |
| | DOP | 0.20 |
| 4th Layer | Gelatin | 0.94 |
| (UV absorbing layer) | AI-1 | 0.02 |
| | UV absorbent (UV-1) | 0.17 |
| | UV absorbent (UV-2) | 0.27 |
| | Antistaining agent (HQ-5) | 0.06 |
| 3rd Layer | Gelatin | 1.30 |
| (Green-sensitive layer) | AI-2 | 0.01 |
| | Green-sensitive Emulsion (EM-G) | 0.12 |
| | Magenta coupler (M-1) | 0.05 |
| | Magenta coupler (M-2) | 0.15 |
| | Dye image stabilizer (ST-3) | 0.10 |
| | Dye image stabilizer (ST-4) | 0.02 |
| | DIDP | 0.10 |
| | UV absorbent (UV-2) | 0.10 |
| | Image stabilizer C | 0.20 |
| 2nd layer | Gelatin | 1.20 |

-continued

| Layer | Constitution | Amount (g/m$^2$) |
|---|---|---|
| (Interlayer) | AI-3 | 0.01 |
| | Antistaining agent (HQ-1) | 0.02 |
| | Antistaining agent (HQ-2) | 0.03 |
| | Antistaining agent (HQ-3) | 0.06 |
| | Antistaining agent (HQ-4) | 0.03 |
| | Antistaining agent (HQ-5) | 0.03 |
| | DIDP | 0.04 |
| | DBP | 0.02 |
| 1st layer | Gelatin | 1.10 |
| (Blue-sensitive layer) | Blue-sensitive Emulsion (Em-B) | 0.24 |
| | Yellow coupler (Y-1) | 0.10 |
| | Yellow coupler (Y-2) | 0.30 |
| | Yellow coupler (Y-3) | 0.05 |
| | Dye image stabilizer (ST-1) | 0.10 |
| | Dye image stabilizer (ST-2) | 0.10 |
| | Dye image stabilizer (ST-5) | 0.10 |
| | Antistaining agent (HQ-1) | 0.005 |
| | Image stabilizer A | 0.08 |
| | Image stabilizer B | 0.04 |
| | DNP | 0.05 |
| | DBP | 0.15 |
| Support | Polyethylene-laminated paper containing a small amount of colorant | |

SU-1: Sodium tri-i-ptopylnaphthalenesulfonate
SU-2: Di(2-ethylhexyl)sulfosuccinate sodium salt
SU-3: 2,2,3,3,4,4,5,5-Octafluoropentyl sulfosuccinate sodium salt
DBP: Dibutyl phthalate
DNP: Dinonyl phthalate
DOP: Dioctyl phthalate
DIDP: Diisodecyl phthalate
H-1: Tetrakis(vinylsulfonylmethyl)methane
H-2: 2,4-Dichloro-6-hydroxy-s-triazine sodium salt
HQ-1: 2,5-di-t-octylhydroquinone
HQ-2: 2,5-di-sec-dodecylhydroquinone
HQ-3: 2,5-di-sec-tetradecylhydroquinone
HQ-4: 2-sec-dodecyl-5-sec-tetradecyhydroquinone
HQ-5: 2,5-di [(1,1-dimethyl-4-hexyloxycarbonyl)butyl]-hydroquinone
Image stabilizer A: p-t-Octylphenol
Image stabilizer B: poly(t-butylacrylamide)
Image stabilizer C: oleyl alcohol

Y-1

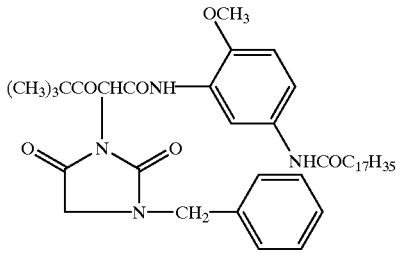

Y-2

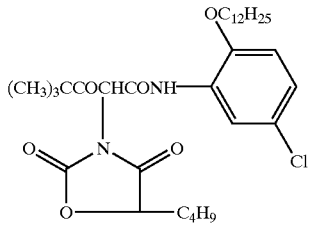

-continued
Y-2
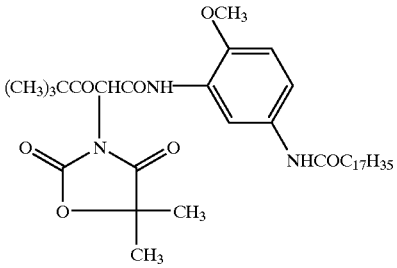
M-1
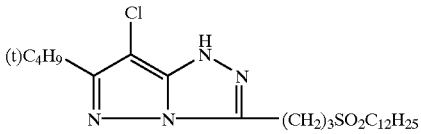
M-2
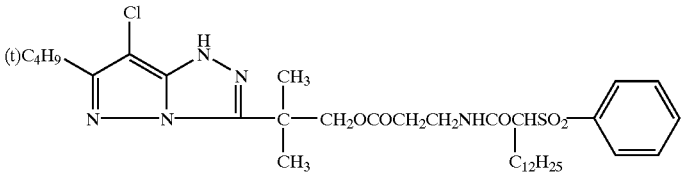
C-1
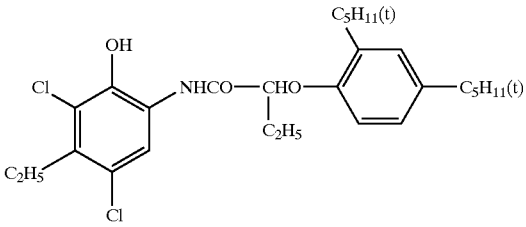
C-2
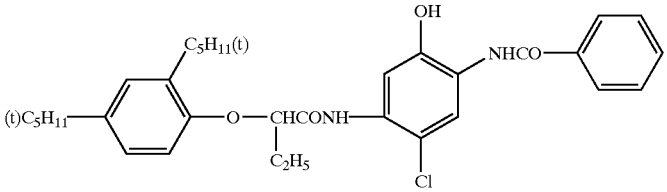
ST-1
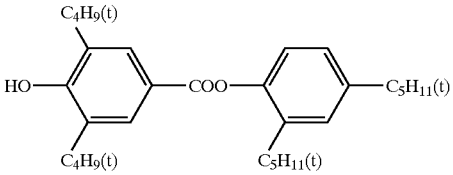
ST-2
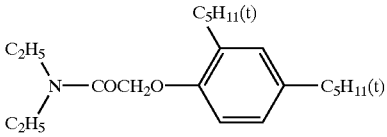
ST-3
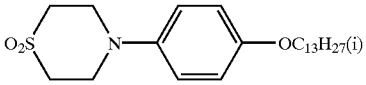
ST-4
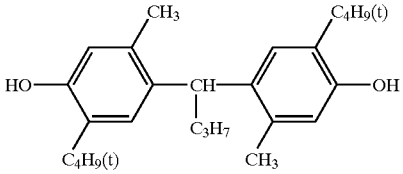
ST-5
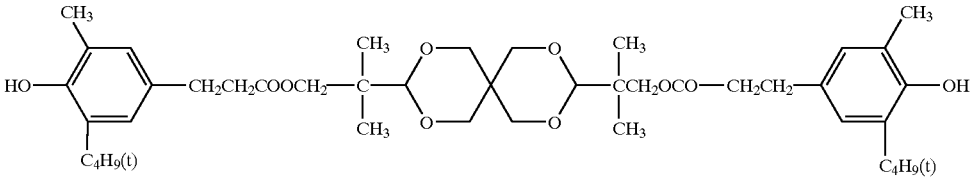

-continued

UV-1

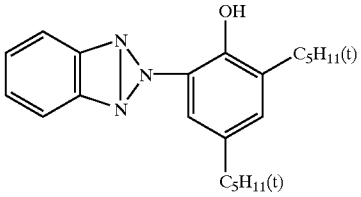

UV-2

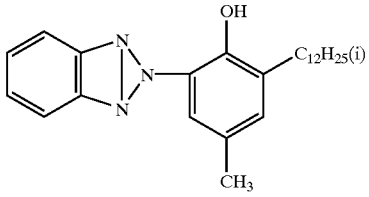

AI-1

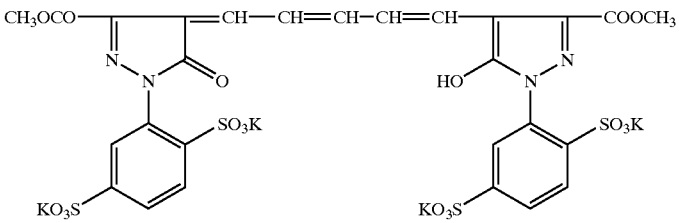

AI-2

AI-3

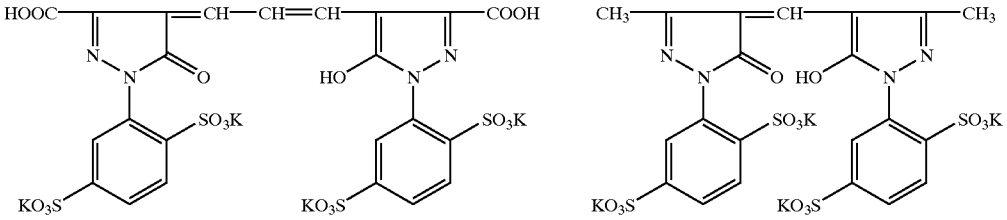

F-1

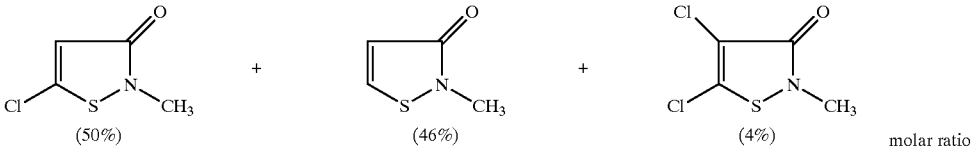

(50%) (46%) (4%) molar ratio

Preparation of Blue-sensitive Silver Halide Emulsion

To 1 liter of aqueous 2% gelatin solution kept at 40° C. were simultaneously added the following solutions (Solutions A and B) in 30 min., while being maintained at a pAg of 7.3 and pH of 3.0, and further thereto were added Solutions C1 and D1 in 180 min., while being maintained at a pAg of 8.0 and pH of 5.5. The pAg was controlled by the method described in JP-A 59-45437, and the pH was adjusted using aqueous sulfuric acid or sodium hydroxide solution.

| | |
|---|---|
| Solution A1 | |
| Sodium chloride | 3.42 g |
| Potassium bromide | 0.03 g |
| Water to make | 200 ml |
| Solution B1 | |
| Silver nitrate | 10 g |
| Water to make | 200 ml |
| Solution C1 | |
| Sodium chloride | 102.7 g |
| $K_2IrCl_6$ | $4 \times 10^{-8}$ mol |
| Potassium bromide | 1.0 g |
| Water to make | 600 ml |
| Solution D1 | |
| Silver nitrate | 300 g |
| Water to make | 600 ml |

After completing the addition, the resulting emulsion was desalted using a 5% aqueous solution of Demol N (produced by Kao-Atlas) and aqueous 20% magnesium sulfate solution, and re-dispersed in a gelatin aqueous solution to obtain a monodisperse cubic grain emulsion (EMP-1) having an average grain size of 0.71 μm, a coefficient of variation of grain size of 0.07 and a chloride content of 99.5 mol %. Further, a monodisperse cubic grain emulsion (EMP-1B) having an average grain size of 0.64 μm, a coefficient of variation of grain size of 0.07 and a chloride content of 99.5 mol % was prepared in the same manner as in preparation of EMP-1, except that an adding time of Solutions A1 and B1, and that of C1 and D1 were respectively varied.

The emulsion, EMP-1 was chemically sensitized using the following compounds. The emulsion, EMP-1B was also optimally chemical-sensitized in a similar manner, and then sensitized EMP-1 and EMP-1B were blended in a ratio of 1:1 based on the silver amount to obtain a blue-sensitive silver halide emulsion (101R).

| | |
|---|---|
| Sodium thiosulfate | 0.8 mg/mol AgX |
| Chloroauric acid | 0.5 mg/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |
| Sensitizing dye BS-1 | $4 \times 10^{-4}$ mol/mol AgX |
| Sensitizing dye BS-2 | $1 \times 10^{-4}$ mol/mol AgX |

Preparation of Green-sensitive Silver Halide Emulsion

Monodisperse cubic grain emulsions, EMP-2 having an average grain size of 0.40 μm, a variation coefficient of 0.08 and a chloride content of 99.5 mol % was prepared in the same manner as in preparation of EMP-1, except that an adding time of Solutions A1 and B1, and that of Solution C1 and D1 were respectively varied. Similarly was obtained monodisperse cubic silver halide emulsion EMP-2B having an average grain size of 0.50 μm, a variation coefficient of 0.08 and a chloride content of 99.5 mol %.

The emulsion, EMP-2 was optimally chemical-sensitized at 55° C. using the following compounds. The emulsion, EMP-2B was also optimally chemical-sensitized in a similar manner, and then sensitized EMP-2 and EMP-2B emulsions were blended in a ratio of 1:1 based on the silver amount to obtain a green-sensitive silver halide emulsion (EM-G).

| | |
|---|---|
| Sodium thiosulfate | 1.5 mg/mol AgX |
| Chloroauric acid | 1.0 mg/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |
| Sensitizing dye GS-1 | $4 \times 10^{-4}$ mol/mol AgX |

Preparation of Red-sensitive Silver Halide Emulsion

Monodisperse cubic grain emulsions, EMP-21 through EMP-29, each having an average grain size of 0.40 μm, a variation coefficient of 0.08 and a chloride content of 99.5 mol % were prepared in the same manner as in preparation of EMP-2, except that the kind of a metal compound, its added amount (doping amount) and its added range (doping region) were varied as shown in Table 2.

TABLE 2

| | Iridium Compound A | | | Strong Electron Trap Compound B | | |
|---|---|---|---|---|---|---|
| Emulsion No. | Kind | Doping Amount (X) | Doping Region | Kind | Doping Amount (Y) | Doping Region |
| EMP-21 (Comp.) | A-1 | 100 | 50–100% | — | — | — |
| EMP-22 (Inv.) | A-1 | 100 | 50–100% | B-9 | 10 | 0–50% |
| EMP-23 (Inv.) | A-1 | 100 | 50–100% | B-9 | 100 | 0–50% |
| EMP-24 (Comp.) | A-1 | 100 | 50–100% | B-9 | 200 | 0–50% |
| EMP-25 (Comp.) | A-1 | 10 | 50–100% | B-9 | 10 | 0–50% |
| EMP-26 (Comp.) | A-1 | 1000 | 50–100% | B-9 | 100 | 0–50% |
| EMP-27 (Inv.) | A-1 | 100 | 50–100% | B-7 | 10 | 0–50% |
| EMP-28 (Inv.) | A-1 | 100 | 50–100% | B-20 | 10 | 0–50% |
| EMP-29 (Comp.) | A-1 | 100 | 50–100% | C-1 | 10 | 0–50% |

In the Table, the doping amounts (X) and (Y) represent an average number of molecules of compounds A and B contained per grain, respectively. The doping region is represented in terms of the volume fraction of a silver nitrate solution added in the grain formation (e.g., it is "0%" at the start of the grain formation and "100%" at the completion of the grain formation).

Emulsions EMP-21 through EMP-29 each were optimally chemically sensitized using the following compounds to obtain red-sensitive silver halide emulsions EM-R21 through EM-R29.

| | |
|---|---|
| Sodium thiosulfate | 1.8 mg/mol AgX |
| Chloroauric acid | 2.0 mg/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |
| Sensitizing dye RS-1 | $1 \times 10^{-4}$ mol/mol AgX |
| Sensitizing dye RS-2 | $1 \times 10^{-4}$ mol/mol AgX |

STAB-1: 1-(3-Acetoamidophenyl)-5-mercaptotetrazole
STAB-2: 1-Phenyl-5-mercaptotetrazole
STAB-3: 1-(4-Ethoxyphenyl)-5-mercaptotetrazole Further, $2.0 \times 10^{-3}$ mol per mol of silver halide was added to each other red-sensitive emulsion.

BS-1

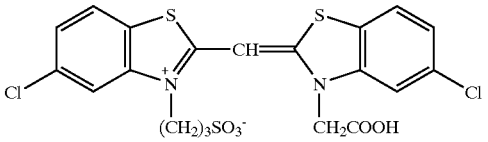

BS-2

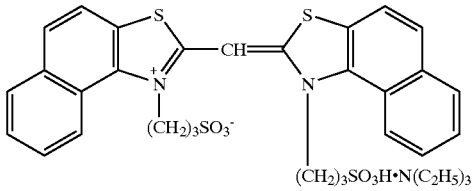

GS-1

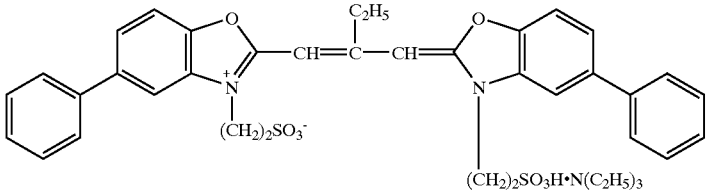

RS-1

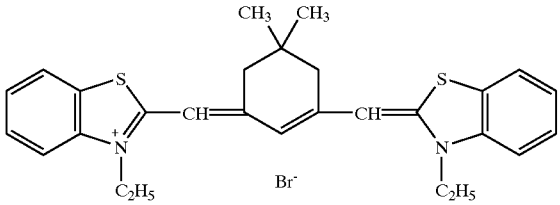

-continued

RS-2

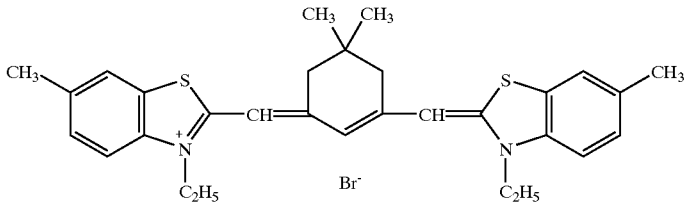

SS-1

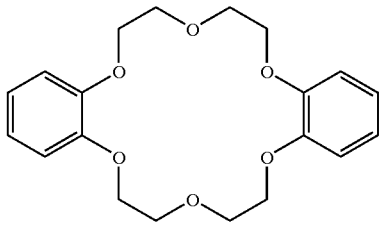

The thus prepared multi-layer color photographic material was denoted as Sample No. 201. Samples No. 202 through 209 were each prepared similarly to Sample No. 201, provided that red-sensitive emulsion Em-R21 was replaced by emulsion Em-R22 through Em-R29, respectively. The thus obtained samples were evaluated with respect to exposure time characteristic and aging stability of performance between after exposure and before start of processing (hereinafter, denoted as latent image stability), and results thereof are shown in Table 5.

Exposure Time Characteristic

Using a tungsten lamp, samples each were optimally exposed at an exposure time of 100 sec or 1 sec. to red light through an optical wedge, in which the intensity was adjusted so as give densities from the minimum density to the maximum density. Similarly, using a xenon flash lamp, samples were exposed to red light at an exposure time of $10^{-3}$ sec. or $10^{-6}$ sec. Exposed samples were processed 1 hr after exposure, according to the following process. Processed samples were subjected to densitometry using densitometer PDA-65 (available from Konica Corp.) with respect to R-density. From the obtained characteristic curve was determined contrast (γ), as defined below:

γ: an average slope of a characteristic curve between densities of 0.5 and 1.5 above a fog density. Contrast variation with exposure time was represented by a difference in γ at an exposure time from that at 1 sec exposure.

Latent Image Stability

Samples which were allowed to stand for 24 hrs. after being exposed at 1 sec and at $10^{-6}$ sec. and then processed, were similarly determined with respect to γ. Latent image stability was evaluated with respect to difference in γ value obtained when processed 24 hrs after exposure from that obtained when processed 1 hr. after exposure.

Results of exposure time characteristic and latent image stability for each sample are shown in Table 3.

| Step | Temperature | Time | Repl. Amt.* |
|---|---|---|---|
| Color developing | 38.0 ± 0.3° C. | 30 sec. | 80 ml |
| Bleach-fixing | 35.0 ± 0.50° C. | 45 sec. | 120 ml |

-continued

| Step | Temperature | Time | Repl. Amt.* |
|---|---|---|---|
| Stabilizing | 30–34° C. | 20 sec. | 150 ml |
| Drying | 60–80° C. | 30 sec. | |

*Replenishing amount

Color developer (Tank solution, Replenisher)

| | Tank soln. | Replenisher |
|---|---|---|
| Water | 800 ml | 800 ml |
| Triethylenediamine | 2 g | 3 g |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N(β-methanesulfonamidoethyl)-3-methyl-4-aminoanilne sulfate | 6.0 g | 10.0 g |
| N,N-diethylhydroxyamine | 6.8 g | 6.0 g |
| Triethanolamine | 10.0 g | 10.0 g |
| Sodium diethyltriaminepentaacetate | 2.0 g | 2.0 g |
| Brightener (4,4'-diaminostilbene-disulfonate derivative) | 2.0 g | 2.5 g |
| Potassium carbonate | 30 g | 30 g |

Water is added to make 1 liter, and the pH of the tank solution and replenisher were respectively adjusted to 10.10 and 10.60 with sulfuric acid or potassium hydroxide.

Bleach-fixer (Tank solution, Replenisher)

| | |
|---|---|
| Ammonium diethyltriaminepentaacetate dihydrate | 65 g |
| diethyltriaminepentaacetic acid | 3 g |
| Ammonium thiosulfate (70% aqueous solution) | 100 ml |
| 2-Amino-5-mercapto-1,3,4-thiadiazole | 2.0 g |
| Ammonium sulfite (40% aqueous solution) | 27.5 ml |

Water is added to make 1 liter, and the pH is adjusted to 5.0.

| Stabilizer (Tank solution, Replenisher) | |
|---|---|
| o-Phenylphenol | 1.0 g |
| 5-Chloro-2-methyl-4-isothiazoline-3-one | 0.02 g |
| 2-Methyl-4-isothiazoline-3-one | 0.02 g |
| Diethylene glycol | 1.0 g |
| Brightener (Chinopal SFP) | 2.0 g |
| 1-Hydroxyethylidene-1,1-diphosphonic acid | 1.8 g |
| Bismuth chloride (40% aqueous solution) | 0.65 g |
| Magnesium sulfate heptahydrate | 0.2 g |
| Polyvinyl pyrrolidine (PVP) | 1.0 g |
| Ammonia water (25% aqueous ammonium hydroxide solution) | 2.5 g |
| Trisodium nitrilotriacetate | 1.5 g |

Water is added to make 1 liter, and the pH is adjusted to 7.5 with sulfuric acid or potassium hydroxide.

TABLE 3

| Sample No. | Emulsion No. | Compound X | Compound Y | Exposure Time Characteristic*1 $10^{-6}$ sec | $10^{-3}$ sec | 1 sec | 100 sec | Latent Image Stability*2 $10^{-6}$ sec | 1 sec |
|---|---|---|---|---|---|---|---|---|---|
| 201 (Comp.) | EMP-21 | 100 | 0 | −2.83 | −2.24 | 0 | −0.26 | +0.57 | +0.43 |
| 202 (Inv.) | EMP-22 | 100 | 10 | −0.41 | −0.33 | 0 | −0.27 | +0.27 | +0.24 |
| 203 (Inv.) | EMP-23 | 100 | 100 | −0.45 | −0.29 | 0 | −0.34 | +0.24 | +0.18 |
| 204 (Comp.) | EMP-24 | 100 | 200 | −1.04 | −0.63 | 0 | −1.22 | +0.13 | −0.24 |
| 205 (Comp.) | EMP-25 | 10 | 10 | −3.35 | −2.67 | 0 | −2.45 | −0.12 | −0.08 |
| 206 (Comp.) | EMP-26 | 1000 | 100 | −0.32 | −0.22 | 0 | +0.08 | +0.87 | +0.75 |
| 207 (Inv.) | EMP-27 | 100 | 10 | −0.43 | −0.29 | 0 | −0.29 | +0.31 | +0.25 |
| 208 (Inv.) | EMP-28 | 100 | 10 | −0.39 | −0.27 | 0 | −0.26 | +0.27 | +0.28 |
| 209 (Comp.) | EMP-29 | 100 | 10 | −2.85 | −2.27 | 0 | −0.20 | +0.61 | +0.47 |

*1Difference in γ at each exposure time, from that at 1 sec exposure.
*2Difference in γ at being processed 24 hr after exposure from that at being processed 1 hr after exposure The contrast (γ value) at each exposure time is correlated to a reciprocity law failure characteristic, and therefore, less variation in with exposure time, i.e., a γ value closer to 0 is more preferable. The latent image stability represents a variation in value with variation of the time of from exposure to processing and a value closer to 0 is more preferable.

It was proved that Sample No. 201, which comprised an emulsion containing iridium compound (A-1) alone, exhibited a markedly reduced γ value (low contrast) and problems arose in latent image stability. It was also proved that inventive Sample 202 exhibited minimized variation in the γ value over the exposure time range of $10^{-6}$ sec. to 100 sec. and resulted in improved latent image stability. As is apparent from the results of Sample Nos. 203 through 206, only when the content of iridium compound (A) per grain, X and the content of compound (B) per grain, Y met the requirements of $10<X<1000$ and $0<Y\leqq X$, the desired effects of the invention were achieved. It was further apparent from Samples Nos. 207 to 209 that a compound to be combined with the iridium compound (A) needed to be selected from the compounds defined as compound (B), thereby leading to improved results.

Example 3

Monodisperse cubic grain emulsions, EMP-31 through EMP-39, each having an average grain size of 0.40 μm, a variation coefficient of 0.08 and a chloride content of 99.5 mol % were prepared in the same manner as in preparation of emulsions EMP-21 through EMP-29, except that the region of adding the compound (A) or compound (B), i.e., the doping region was varied as shown in Table 4. Subsequently, using the thus prepared emulsions EMP-31 through EMP-39, red-sensitive emulsions Em-R31 through Em-R39 were prepared.

Photographic material Samples Nos. 31 through 39 were prepared in the same manner as Sample No. 201, except that red-sensitive emulsion Em-R21 was replaced by each of Em-R31 through Em-R39, as shown in Table 5. The thus prepared samples were evaluated with respect to exposure time characteristic and latent image stability, similarly to Example 2. Results thereof are shown in Table 5.

TABLE 4

| Emulsion No. | Iridium Compound A Kind | Doping Amount (X) | Doping Region | Strong Electron Trap Compound B Kind | Doping Amount (Y) | Doping Region |
|---|---|---|---|---|---|---|
| EMP-31 (Comp.) | A-1 | 100 | 90–100% | — | — | — |
| EMP-32 (Comp.) | — | — | — | B-9 | 10 | 90-100% |
| EMP-33 (Inv.) | A-1 | 100 | 90–100% | B-9 | 10 | 0–90% |
| EMP-34 (Inv.) | A-1 | 100 | 0–90% | B-9 | 10 | 90–100% |
| EMP-35 (Inv.) | A-1 | 100 | 0–90% | B-9 | 10 | 0–90% |
| EMP-36 (Inv.) | A-1 | 100 | 0–100% | B-9 | 10 | 0–90% |
| EMP-37 (Inv.) | A-1 | 100 | 70–90% | B-9 | 10 | 0–70% |
| EMP-38 (Inv.) | A-1 | 100 | 70–90% | B-9 | 10 | 60–70% |
| EMP-39 (Inv.) | A-1 | 100 | 70–90% | B-9 | 10 | 50–70% |

In the Table, the doping amounts (X) and (Y) represent an average number of molecules of compounds A and B contained per grain, respectively. The doping region is represented in terms of the volume fraction of a silver nitrate solution added in the grain formation (e.g., it is "0%" at the start of the grain formation and "100%" at the completion of the grain formation).

TABLE 5

| Sample No. | Emulsion No. | Compound X | Compound Y | Exposure Time Characteristic*1 $10^{-6}$ sec | $10^{-3}$ sec | 1 sec | 100 sec | Latent Image Stability*2 $10^{-6}$ sec | 1 sec |
|---|---|---|---|---|---|---|---|---|---|
| 301 (Comp.) | EMP-31 | 90–100 | — | −2.77 | −2.15 | 0 | −0.19 | +0.58 | +0.49 |
| 302 (Comp.) | EMP-32 | — | 90–100 | −3.21 | −2.65 | 0 | −1.88 | −0.05 | +0.07 |

TABLE 5-continued

| Sample | Emul-sion | Compound | | Exposure Time Characteristic*1 | | | | Latent Image Stability*2 | |
|---|---|---|---|---|---|---|---|---|---|
| No. | No. | X | Y | $10^{-6}$ sec | $10^{-3}$ sec | 1 sec | 100 sec | $10^{-6}$ sec | 1 sec |
| 303 (Inv.) | EMP-33 | 90–100 | 0–90 | −0.40 | −0.26 | 0 | −0.19 | +0.27 | +0.22 |
| 304 (Inv.) | EMP-34 | 0–90 | 90–100 | −0.56 | −0.33 | 0 | −0.36 | +0.29 | +0.20 |
| 305 (Inv.) | EMP-35 | 0–90 | 0–90 | −0.25 | −0.21 | 0 | −0.15 | +0.18 | +0.15 |
| 306 (Inv.) | EMP-36 | 0–100 | 0–90 | −0.22 | −0.19 | 0 | −0.10 | +0.14 | +0.20 |
| 307 (Inv.) | EMP-37 | 70–90 | 0–70 | −0.18 | −0.14 | 0 | −0.12 | +0.08 | +0.13 |
| 308 (Inv.) | EMP-38 | 70–90 | 60–70 | −0.39 | −0.27 | 0 | −0.26 | +0.27 | +0.28 |
| 309 (Inv.) | EMP-39 | 70–90 | 50–70 | −0.15 | −0.16 | 0 | −0.15 | +0.09 | +0.08 |

*1Difference in γ at each exposure time from that at 1 sec exposure.
*2Difference in γ at being processed 24 hr after exposure from that at being process 1 hr after exposure In the Example, correlations of the doping regions of the iridium compound (A) and compound (B) with the resulting improvements are shown. Thus, in Sample Nos. 301 and 302, in which the emulsion was doped with either one of two compounds, marked deteriorations was observed in either or both of exposure time characteristic and latent image stability.

In the emulsion used in Sample No. 303, compound (B-9) was doped over a wide range in the interior of the silver halide grain and compound (A-1) was doped external thereto, i.e., in a region from the grain surface to a depth of 10% of the grain volume. In the emulsion used in Sample No. 304, on the other hand, compounds (A-1) and (B-9) were interchanged in the doping regions relative to each other. Both samples satisfied the constitution of the invention and achieved improvement effects, but it was proved that Sample No. 303 using an emulsion, in which compound (A-1) was located in the region closer to the grain surface than compound (B-9) was preferable.

In the emulsion used in Sample No. 306, the doping region of compound (B-9) was identical to that of the emulsion used in Sample No. 305 but compound (A-1) was doped to the grain surface. Unless compound (B-9) is located in the region closer to the grain surface than compound (A-1), even if both compounds are located in the same region, more preferred results were obtained. Further, the doping region of compound (A-1) extended over a wider region, exhibiting the preferable result of being less variation in contrast, specifically at a short exposure time, in comparison to Sample No. 303 using an emulsion, in which compound (A-1) was doped within a region of 10% of the grain volume.

In Sample Nos. 307 to 309, silver halide grains were used, comprising the region doped with compound (A-1) alone, the region doped with compound (B-9) and the region not doped with any one of both compounds. Specifically, grains having the doping region of compound (B-9) of greater than 10% of the grain volume exhibited the greatest effects of the invention.

Example 4

Monodisperse cubic grain emulsions, EMP-41 through EMP-49, each having an average grain size of 0.40 μm, a variation coefficient of 0.08 and a chloride content of 99.5 mol % were prepared in the same manner as in preparation of EMP-21 through EMP-29 in Example 2, except that the kind of a metal compound, its added amount (doping amount) and its added range (doping region) were varied as shown in Table 6 and the added compounds were so added that they were doped in the same region. Subsequently, red-sensitive silver halide emulsions Em-R41 through Em-R49 were prepared in the same manner as in Em-R21 through Em-R29 in Example 2, except that emulsions EMP-21 through EMP-29 were replaced by emulsions EMP-41 through EMP-49, respectively. Further, photographic material Samples No. 401 through 409 were prepared in the same manner as Sample No. 201, except that red-sensitive emulsion Em-R21 was replaced by each of emulsions Em-R41 through Em-R49. The thus prepared samples were evaluated similarly to Example 2 with respect to exposure time characteristic and latent image stability. Results thereof are shown in Table 7.

TABLE 6

| Emulsion No. | Doping Region of (A-1), (B-9) and Compound (C) | Doping Amount X of (A-1) | Doping Amount Y of (B-9) | CN Ligand-containing Compound (C) Kind | Doping Amount Z | Ratio Z/Y |
|---|---|---|---|---|---|---|
| EMP-41 (Comp.) | 0–100% | 50 | 100 | — | — | — |
| EMP-42 (Comp.) | 0–100% | 50 | 100 | C-1 | 10000 | 100 |
| EMP-43 (Inv.) | 0–100% | 50 | 100 | C-1 | 100000 | 1000 |
| EMP-44 (Comp.) | 0–100% | 50 | 100 | C-1 | 1000000 | 10000 |
| EMP-45 (Comp.) | 0–100% | 50 | 1000 | C-1 | 100000 | 100 |
| EMP-46 (Inv.) | 0–100% | 50 | 50 | C-1 | 100000 | 2000 |
| EMP-47 (Inv.) | 0–100% | 50 | 50 | C-3 | 100000 | 2000 |
| EMP-48 (Inv.) | 0–90% | 50 | 50 | C-1 | 100000 | 2000 |
| EMP-49 (Inv.) | 0–85% | 50 | 50 | C-1 | 100000 | 2000 |

TABLE 6-continued

| Emulsion No. | Doping Region of (A-1), (B-9) and Compound (C) | Doping Amount X of (A-1) | Doping Amount Y of (B-9) | CN Ligand-containing Compound (C) Kind | Doping Amount Z | Ratio Z/Y |
|---|---|---|---|---|---|---|

In the Table, the doping amounts X, Y and Z each represent an average number of molecules of compounds (A-1), (B-9) and (C) contained per grain, respectively. The doping region is represented in terms of the volume fraction of a silver nitrate solution added in the grain formation (e.g., it is "0%" at the start of the grain formation and "100%" at the completion of the grain formation).

variation coefficient of 0.08 and a chloride content of 99.5 mol % were prepared similarly to the preparation of EMP-21 through EMP-29 in Example 2, provided that the kind of a metal compound, its added amount (doping amount) and its added range (doping region) were varied as shown in Table 8. Subsequently, red-sensitive silver halide emulsions Em-R51 through Em-R5 were prepared similarly to Em-R21 through Em-R29 in Example 2, provided that emulsions EMP-51 through EMP-56 were used in place of EMP-21 through EMP-29. Further, photographic material Samples No. 501 through 506 were prepared in the same manner as Sample No. 201, except that red-sensitive emulsion Em-R21 was replaced by each of emulsions Em-R51 through Em-R56. The thus prepared samples were evaluated similarly to Example 2 with respect to exposure time characteristic and latent image stability. Results thereof are shown in Table 9.

TABLE 7

| Sample No. | Emulsion No. | Doping Region | Z/Y | Exposure Time Characteristic*1 $10^{-6}$ sec | $10^{-3}$ sec | 1 sec | 100 sec | Latent Image Stability*2 $10^{-6}$ sec | 1 sec |
|---|---|---|---|---|---|---|---|---|---|
| 401 (Comp.) | EMP-41 | — | — | −2.98 | −2.44 | 0 | −1.69 | +0.23 | +0.19 |
| 402 (Comp.) | EMP-42 | 0–100% | 100 | −2.61 | −2.45 | 0 | −1.58 | +0.25 | +0.17 |
| 403 (Inv.) | EMP-43 | 0–100% | 1000 | −0.39 | −0.22 | 0 | −0.20 | +0.23 | +0.19 |
| 404 (Comp.) | EMP-44 | 0–100% | 10000 | −0.66 | −0.33 | 0 | +0.36 | +0.49 | +0.50 |
| 405 (Comp.) | EMP-45 | 0–100% | 100 | −3.03 | −2.22 | 0 | −0.93 | +0.27 | +0.20 |
| 406 (Inv.) | EMP-46 | 0–100% | 2000 | −0.27 | −0.23 | 0 | −0.15 | +0.18 | +0.15 |
| 407 (Inv.) | EMP-47 | 0–100% | 2000 | −0.29 | −0.25 | 0 | +0.04 | +0.25 | +0.23 |
| 408 (Inv.) | EMP-48 | 0–90% | 2000 | −0.29 | −0.18 | 0 | −0.11 | +0.18 | +0.17 |
| 409 (Inv.) | EMP-49 | 0–85% | 2000 | −0.21 | −0.16 | 0 | −0.15 | +0.09 | +0.08 |

*1Difference in γ at each exposure time from that at 1 sec exposure.
*2Difference in γ at being processed 24 hr after exposure from that at being process 1 hr after exposure.

In this Example, when newly combined with CN ligand-containing compound (C), the correlation of the ratio of compound (C) to compound (B) and improvement effects are demonstrated.

Emulsion grains used in Sample No. 401 were doped with compounds (A-1) and (B-9) but their doping amounts did not meet the requirements of the invention, as shown in Example 2 and 3, and it was proved that specifically marked deterioration in exposure time characteristic was noticed and unacceptable in practical use. In Sample Nos. 402 to 405 showing the correlation of Z and Y, i.e., average number of molecules of Compound (C) and (B) per grain, it was proved that only Sample No. 403 which contained an emulsion meeting the requirement of $100<Z/Y<10000$ resulted in improvements in both exposure time characteristic and latent image stability. It was also shown from the results of Sample Nos. 406 and 407 that even when compound (C-1) was replaced by compound (C-3), similar improvements were achieved. Of Sample Nos. 408 and 409, which contained emulsion grains containing no dopant in the region near the grain surface, Sample No. 40 containing grains, in which compound (C) was not contained in a depth of 10% from the grain surface, achieved enhanced effects of the invention.

Example 5

Monodisperse cubic grain emulsions, EMP-51 through EMP-56, each having an average grain size of 0.40 μm, a

TABLE 8

| Emulsion No. | Ir Compound (A-1) Doping region | X | Strong Electron Trap Compound (B-9) Doping region | Y | CN Ligand-containing Compound (C-1) Doping Region | Z | Z/Y |
|---|---|---|---|---|---|---|---|
| EMP-51 (Inv.) | 0–85% | 50 | 0–85% | 30 | 0–100% | 30000 | 1000 |
| EMP-52 (Inv.) | 0–85% | 50 | 0–85% | 30 | 0–85% | 30000 | 1000 |
| EMP-53 (Inv.) | 0–100% | 50 | 0–85% | 30 | 0–85% | 30000 | 1000 |
| EMP-54 (Inv.) | 85–100% | 50 | 0–85% | 30 | 0–85% | 30000 | 1000 |
| EMP-55 (Inv.) | 50–85% | 50 | 0–50% | 30 | 50–85% | 30000 | 1000 |
| EMP-56 (Inv.) | 50–85% | 50 | 0–50% | 30 | 0–85% | 30000 | 1000 |

TABLE 8-continued

| | Ir Compound (A-1) | | Strong Electron Trap Compound (B-9) | | CN Ligand-containing Compound (C-1) | | |
|---|---|---|---|---|---|---|---|
| Emulsion No. | Doping region | X | Doping region | Y | Doping Region | Z | Z/Y |

In the Table, the doping amounts X, Y and Z represent an average number of molecules of compounds (A), (B) and (C) contained per grain, respectively. The doping region is represented in terms of the volume fraction of a silver nitrate solution added in the grain formation (e.g., it is "0%" at the start of the grain formation and "100%" at the completion of the grain formation).

TABLE 9

| Sample | Doping Region (A-1) | (B-1) | (C-1) | Exposure Time Characteristic*1 | | | | Latent Image Stability*2 | |
|---|---|---|---|---|---|---|---|---|---|
| No. | X = 50 | Y = 30 | Z = 30000 | $10^{-6}$ sec | $10^{-3}$ sec | 1 sec | 100 sec | $10^{-6}$ sec | 1 sec |
| 501 (Inv.) | 0–85% | 0–85% | 0–100% | −0.36 | −0.21 | 0 | −0.16 | +0.21 | +0.18 |
| 502 (Inv.) | 0–85% | 0–85% | 0–85% | −0.21 | −0.16 | 0 | −0.25 | +0.08 | +0.07 |
| 503 (Inv.) | 0–100% | 0–85% | 0–85% | −0.23 | −0.12 | 0 | −0.19 | +0.10 | +0.09 |
| 504 (Inv.) | 85–100% | 0–85% | 0–85% | −0.18 | −0.18 | 0 | −0.22 | +0.12 | +0.10 |
| 505 (Inv.) | 50–85% | 0–50% | 50–85% | −0.20 | −0.09 | 0 | −0.12 | +0.07 | +0.05 |
| 506 (Inv.) | 50–85% | 0–50% | 0–85% | −0.12 | +0.03 | 0 | −0.08 | +0.05 | +0.06 |

*1Difference in γ at each exposure time from that at 1 sec exposure.
*2Difference in γ at being processed 24 hr after exposure from that at being process 1 hr after exposure.

In this Example is shown correlation of combinations of the doping regions of compounds (A), (B) and (C) with the resulting improvement effects. As is shown in Example 4, it was proved from Samples Nos. 501 and 502 that when compound (C) was not contained within the region of from the grain surface to a depth of 10%, enhanced effects of the invention were preferably achieved. As was noted for Sample Nos. 501 to 504, iridium compound (A) was preferably doped in the which was the same as or closer to the grain surface he doping region of compound (C).

Sample Nos. 505 and 506, which comprised emulsion grains containing no compound doped near the grain surface were shown to achieve enhanced improvements in latent image stability. Specifically, it was noted that in Sample No. 506 using emulsion grains in which compound (B) and (C) were doped in the same region resulted superior improvements.

Example 6

Green-sensitive silver halide emulsion Em-G39 and blue-sensitive silver halide emulsion Em-B39 were prepared similarly to Em-R39 in Example 3. Using these green-sensitive and blue-sensitive emulsions in Sample 309 was prepared photographic material Sample No. 601, in which the red-, green- and blue-sensitive emulsions all met the requirement of the invention. Sample No. 602 was also prepared similarly to Sample No. 506 in Example 5, in which green-and blue-sensitive silver halide emulsions were prepared similarly to the red-sensitive silver halide emulsion Em-R56.

The thus prepared Sample Nos. 601 and 602, and Sample No. 201 of Example 2 were each evaluated with respect to exposure characteristic and latent image stability, similarly to Example 2, provided that suitable filters were arranged in front of a tungsten lamp and a xenon flash lamp to adjust the light amount and B/G/R components so that obtained images exhibited a neutral gray.

Comparative Sample No. 201, when exposed at various exposure times, and specifically, exposed at a high intensity for a short duration, resulted in unbalanced and low contrast for R, G and B, which were unacceptable for practical use. Problems also rose with latent image stability, resulting in marked variations in contrast for B, G and R during aging after exposure and leading to deteriorated gray-balance. On the contrary, in inventive Sample Nos. 601 and 602, optimally high contrast was achieved irrespective of the exposure time and no deterioration in gray-balance was noticed in any of the B, G and R characteristic curves. Further, superior latent image stability was achieved, leading to a stable contrast and gray-balance irrespective of being aged after exposure.

From the foregoing results, it was proved that improvement effects achieved by the red-sensitive silver halide emulsion according to the invention could also be achieved by the green-sensitive and blue-sensitive silver halide emulsions and silver halide color photographic materials using such emulsions exhibited superior characteristics.

Example 7

Using a commonly used enlarger, Sample Nos. 201, 601 and 602 were each exposed through images of a processed color negative (Konica Color Centuria 400) and processed in a manner similar to Example 2. Thus, using each Sample, prints of sizes 82×117 mm, 102×127 mm, 254×305 mm and 508×610 mm were prepared by varying the enlarging ratio. In making prints of various sizes for each sample, the filter condition was adopted so as to form the most suited images at a size of 102×127 mm.

A 508×610 mm size print obtained from Comparative Sample No. 201 appeared to be entirely bluish, giving a relatively low contrast image and was rather difficult to obtain equivalent quality prints of 82×117 mm and 102×127 mm sizes. On the contrary, in the case of using Sample Nos. 601 and 602, variations in color balance and tone were minimized for respective print sizes and prints with stable quality were efficiently prepared. Further even when changing the time between exposure and processing from 10 min. to 1 hr., 6 hrs or 24 hrs., high quality prints were stably obtained in Sample Nos. 601 and 602. Thus, it was shown that using silver halide color photographic materials according to the invention, superior color prints were obtained through the conventional analog planar exposure system.

Example 8

Sample Nos. 601, 602 and 201 used in Example 6 were also evaluated with respect to suitability for digital exposure. Negative images obtained from Konica Color Centuria 400 were converted to digitized data and converted to an environment capable of using a software program, Photoshop (Version 5, available from Adobe). To an introduced image, text of various sizes and thin lines were added to form image data and operated so as to be exposed using the following digital scanning exposure apparatus. As light sources were employed a 473 nm laser obtained by wavelength conversion of YAG solid laser (at an oscillation wavelength of 946 nm) through SHG crystal of $KNbO_3$ using a semiconductor laser, GaAlAs (at an oscillation wavelength of 808.5 nm) as an excitation light source; a 532 nm laser obtained by wavelength conversion of a $YVO_4$ solid laser (oscillation wavelength of 1064 nm) through SHG crystal of KTP using a semiconductor laser, GaAlAs (at an oscillation wavelength of 808.5 nm) as an excitation light source; and AlGaInP laser (at an oscillation wavelength of 670 nm). There was prepared an apparatus, in which these three color laser lights were each vertically transferred in the scanning direction using a polygon mirror and sequentially expose a color print paper. The exposure amount was adjusted by electrically controlling the amount of the semiconductor laser light. Scanning exposure was performed at 400 dpi (in which "dpi" means the number of dots per 2.54 cm) and at an exposure time per picture element of $5\times10^{-8}$ sec. The exposure amount was adjusted so as to obtain optimal prints for each sample and after subjected to scanning exposure, exposed samples were processed similarly to example 2 to obtain prints of a 102×127 mm size.

In prints obtained from comparative Sample No. 201 densities for respective colors and black color tone were insufficient, producing entirely too low contrast images without reproducing tone in the shadow portions. It was further noticed that text bleeded out and thin lines to be blackened appeared to be cyan-colored, and prints acceptable in practical use were not obtained even when exposure was adjusted over all the possible conditions. On the contrary, in prints obtained from Sample Nos. 601 and 602, prints having quality equivalent to those obtained in the analog planar exposure system in Example 7 were easily obtained, achieving high quality prints acceptable in practical use. No bleeding or discrepancy in color was noticed in text and thin lines and high contrast images were invariably achieved.

Using the same image information and samples as above, exposure was performed by printer processor QDP-1500a used in Konica Digital Mine-Lab System QD-21 and processing was run by a process of CPK-HQA-P using processing chemicals of ECOJET-HQA-P. As a result, similarly to example 1, it was proved that inventive samples achieved effects of the invention. Similarly to the foregoing, prints obtained from Sample Nos. 601 and 602 consistently exhibited superior quality. Thus, it was proved that even in the process of obtaining color prints through a digital scanning-exposure system, superior color prints were obtained using silver halide color photographic materials according to the invention.

What is claimed is:

1. A silver halide emulsion comprising silver halide grains, wherein the silver halide grains each have a chloride content of not less than 90 mol % and are internally doped with an iridium compound (A) and a compound (B) forming a stronger electron trap than said iridium compound (A), the silver halide grains meeting the following requirement:

$$10<X<1000 \text{ and } 0<Y\leq X$$

wherein X represents an average number of molecules of said iridium compound (A) contained per grain and Y represents an average number of molecules of said compound (B) contained per grain, and wherein said compound (B) is doped in an interior region which is the same as or internal to an interior region doped with said compound (A) and the silver halide grains each have at least a region doped with said iridium compound (A) alone, a region doped with said compound (B) alone and a region doped with neither said iridium compound (A) nor said compound (B) within the grain, and each of the region doped with said iridium compound (A) and the region doped with said compound (B) accounting for a least 10% by volume of the grain.

2. The silver halide emulsion of claim 1, wherein said iridium compound (A) is a six-coordinate complex containing at least a halogen atom as a ligand, said compound (B) being a compound represented by the following formula (II):

$$R_n[MX_mY_{6-m}] \qquad \text{formula (II)}$$

wherein M is a metal selected from the group consisting of ruthenium, rhodium and osmium; R is an alkali metal; m is an integer of 0 to 6 and n is 2 or 3; X and Y are each a ligand.

3. The silver halide emulsion of claim 2, wherein said iridium compound (A) is a six-coordinate complex containing six halogen atoms as ligands.

4. The silver halide emulsion of claim 2, wherein in formula (II), X and Y each are selected from the group consisting of nitrosyl, thionitrosyl, and carbonyl and a halide ion, and a part or all of ligands are halide ions.

5. The silver halide emulsion of claim 1, wherein the silver halide grains each have an equivalent sphere diameter of 0.1 to 1.2 $\mu$m.

6. The silver halide emulsion of claim 5, wherein the silver halide grains each have a equivalent sphere diameter of 0.2 to 1.0 $\mu$m.

7. A method for preparing a silver halide emulsion comprising silver halide grains, each having a chloride content of not less than 90 mol % and being internally doped with an iridium compound (A) and a compound (B) forming a stronger electron trap than said iridium compound (A), the method comprising forming silver halide grains by adding a sliver salt and a halide salt to an aqueous solution containing a dispersing medium, and further comprising adding an iridium compound (A) and adding a compound (B) during forming the silver halide grains, wherein the silver halide grains meet the following requirement:

$$10<X<1000 \text{ and } 0<Y\leq X$$

wherein X represents an average number of molecules of said iridium compound (A) contained per grain and Y represents an average number of molecules of said compound (B) contained per grain, and wherein each of the addition of said iridium compound (A) and addition of said compound (B) are independently carried out over a period of adding a least 10% of the total amount of the silver salt.

8. The method of claim 7, wherein addition of said compound (B) is carried out simultaneously with or prior to addition of said iridium compound (A).

9. The method of claim 8, wherein the addition of said compound (B) is carried out prior to the addition of said iridium compound (A).

10. The method of claim 7, wherein the method further comprises adding a compound (C) before adding 90% of the total amount of the silver salt, said compound (C) containing a metal selected from group 8 of the periodical table of elements except for iridium and at least one CN as a ligand.

11. The method of claim 10, wherein said compound (C) is added simultaneously with or prior to adding said iridium compound (A), said compound (B) being added simultaneously with adding said compound (A).

12. The method of claim 7, wherein said iridium compound (A) is a six-coordinate complex containing at least a halogen atom as a ligand, said compound (B) being a compound represented by the following formula (II):

$$R_n[MX_mY_{6-m}] \qquad \text{formula (II)}$$

wherein M is a metal selected from the group consisting of ruthenium, rhodium and osmium; R is an alkali metal; m is an integer of 0 to 6 and n is 2 or 3; X and Y are each a ligand.

13. The method of claim 12, wherein said iridium compound (A) is a six-coordinate complex containing six halogen atoms as ligands.

* * * * *